United States Patent [19]

Frei

[11] Patent Number: 4,577,727

[45] Date of Patent: Mar. 25, 1986

[54] SCAFFOLD FOR THE CONSTRUCTION OF ROUND BUILDINGS OF CONCRETE OR THE LIKE

[75] Inventor: Peter Frei, Widnau, Switzerland

[73] Assignee: Patenver AG, Altstätten, Switzerland

[21] Appl. No.: 504,784

[22] Filed: Jun. 16, 1983

[30] Foreign Application Priority Data

Jun. 16, 1982 [AT] Austria ..... 2324/82

[51] Int. Cl.[4] ..... E04G 11/20; E04G 17/14

[52] U.S. Cl. ..... 182/128; 182/82; 249/20

[58] Field of Search ..... 182/128, 187, 188, 223, 182/82, 179; 52/640, 641, 633, 169.7; 249/17, 18, 20, 33, 47

[56] References Cited

U.S. PATENT DOCUMENTS

| | | | |
|---|---|---|---|
| 953,383 | 3/1910 | Holman . | |
| 3,082,843 | 3/1963 | Leonard | 182/82 |
| 3,252,199 | 5/1966 | Bossner | 182/128 |
| 4,002,222 | 1/1977 | Bruno | 182/82 |
| 4,070,846 | 1/1978 | Sohlberg | 52/641 |

FOREIGN PATENT DOCUMENTS

| | | | |
|---|---|---|---|
| 235328 | 3/1960 | Australia | 182/128 |
| 335684 | 3/1977 | Austria . | |
| 340672 | 12/1977 | Austria . | |
| 662441 | 4/1985 | Belgium | 182/179 |
| 2140638 | 3/1973 | Fed. Rep. of Germany . | |
| 2162404 | 3/1973 | Fed. Rep. of Germany . | |
| 2207721 | 8/1973 | Fed. Rep. of Germany . | |
| 7704885 | 6/1977 | Fed. Rep. of Germany . | |
| 2213637 | 3/1981 | Fed. Rep. of Germany . | |
| 1208214 | 2/1960 | France . | |
| 2352131 | 12/1977 | France . | |
| 314238 | 6/1956 | Switzerland | 52/640 |
| 1448672 | 9/1976 | United Kingdom | 182/187 |
| 754020 | 8/1980 | U.S.S.R. | 182/179 |
| 768910 | 10/1980 | U.S.S.R. | 182/187 |

OTHER PUBLICATIONS

Brochure by Peri.
Brochure by Noa.

*Primary Examiner*—Ramon S. Britts
*Assistant Examiner*—Alvin Chin-Shue
*Attorney, Agent, or Firm*—Wenderoth, Lind & Ponack

[57] ABSTRACT

A scaffold to which form plates for forming a concrete wall can be fastened is suitable for circular constructions and includes a polygonal frame which is vertically adjustable along supports. The frame, is angularly adjustable at the corners, of plural straight frame portions, each of which is a separate part attached to the adjacent frame portions.

13 Claims, 11 Drawing Figures

SCAFFOLD FOR THE CONSTRUCTION OF ROUND BUILDINGS OF CONCRETE OR THE LIKE

FIELD AND BACKGROUND OF THE INVENTION

The invention relates to a scaffold for forms of circular constructions of concrete or the like, including a horizontally aligned substantially annular polygonal frame for a working platform. The frame has an upper chord and a lower chord connected by means of truss bars and is vertically adjustably mounted, preferably on three pillar-like supports.

DESCRIPTION OF THE PRIOR ART

A known device for erecting structures, preferably of closed circumference, such as silos, swimming pools, aging towers or the like, of castable materials, e.g. concrete, includes a vertically adjustable working platform. This working platform is mounted on three extensible tubes and mounts an annular lattice beam to which are fixed radial outwardly or inwardly extending supports on which is suspended the external or internal form. As construction progresses, the working platform is lifted together with the suspended forms, when the cast concrete has set.

It is a disadvantage of known working platforms that a separate platform must be provided for each working diameter.

SUMMARY OF THE INVENTION

It is the object of the invention to provide a scaffold in which the working platform can be adapted to different diameters of constructions.

According to the invention this is achieved by providing a polygonal frame which is angularly adjustable at its corners and by providing each portion of the polygonal frame between two corners as a separate part releasably linked, preferably screwed, to the adjacent frame portions.

Preferably upper and lower chords of the portions are joined at the corners in a fork-like manner by connecting flanges arranged alternately against each other in the mounted position.

Hence, the frame portions can be separated at each corner, and by inserting a further frame portion or a number of frame portions the diameter of the frame can be increased as desired, or similarly decreased by removing frame portions. By adjusting the angles at the other corners the polygonal frame can be adapted to the continuous shape of a circle.

It is a further disadvantage of conventional scaffolds that the extensible tubes serving as supporting columns are arranged within the ring of the working platform, and displacement of the working platform, i.e. detaching from and fastening to the guide tubes, is time-consuming and dangerous as these operations can only be carried out below the working platform.

It is a further object of the invention to provide a scaffold which eliminates this disadvantage.

According to the invention this is achieved in that the frame portions rest with their outer sides against the supports and are linked thereto.

It is advantageously provided that the two connecting flanges at one end of the upper and lower chord portions are angularly arranged to the longitudinal axis of the upper and lower chord portions. Acceptable tolerances are therefore possible in the production of the frame portions.

An embodiment of the invention provides that the connecting flanges are provided with holes for connecting screws which lie at least partially on a circular arc. Some of these holes are slots. Advantageously, one hole is positioned at the center of the circular arc.

A further embodiment provides that the connecting flange at one end of each of the upper and lower chord portions is divided into internal and external flange parts arranged at the two sides of the upper or lower chord portion.

BRIEF DESCRIPTION OF THE DRAWINGS

In the following an embodiment of the invention will be described in more detail with reference to the attached drawings, in which.

DESCRIPTION OF THE PREFERRED EMBODIMENTS

Figure 1:
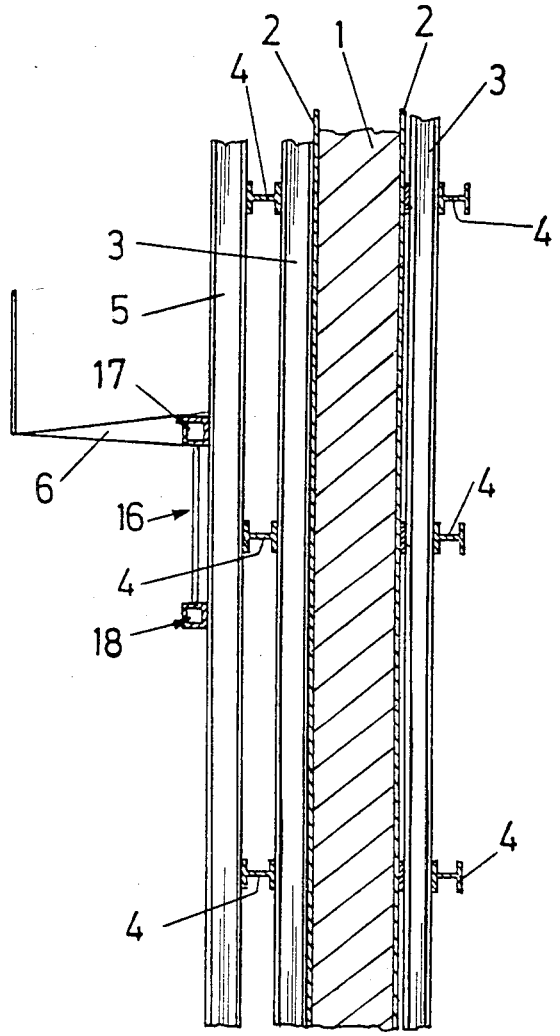
FIG. 1 is a schematic vertical sectional view of a scaffold according to the invention and the form belonging thereto.

In FIG. 1 a wall under construction is shown at 1. A form skin 2, which may for example be of steel, light metal or of wood or plastic material, rests directly against the inner and outer surfaces of the wall 1.

Profiled steel beams 3 of a mounting scaffold are held by external polygonal rings 4 and are bolted thereto.

Figure 2:
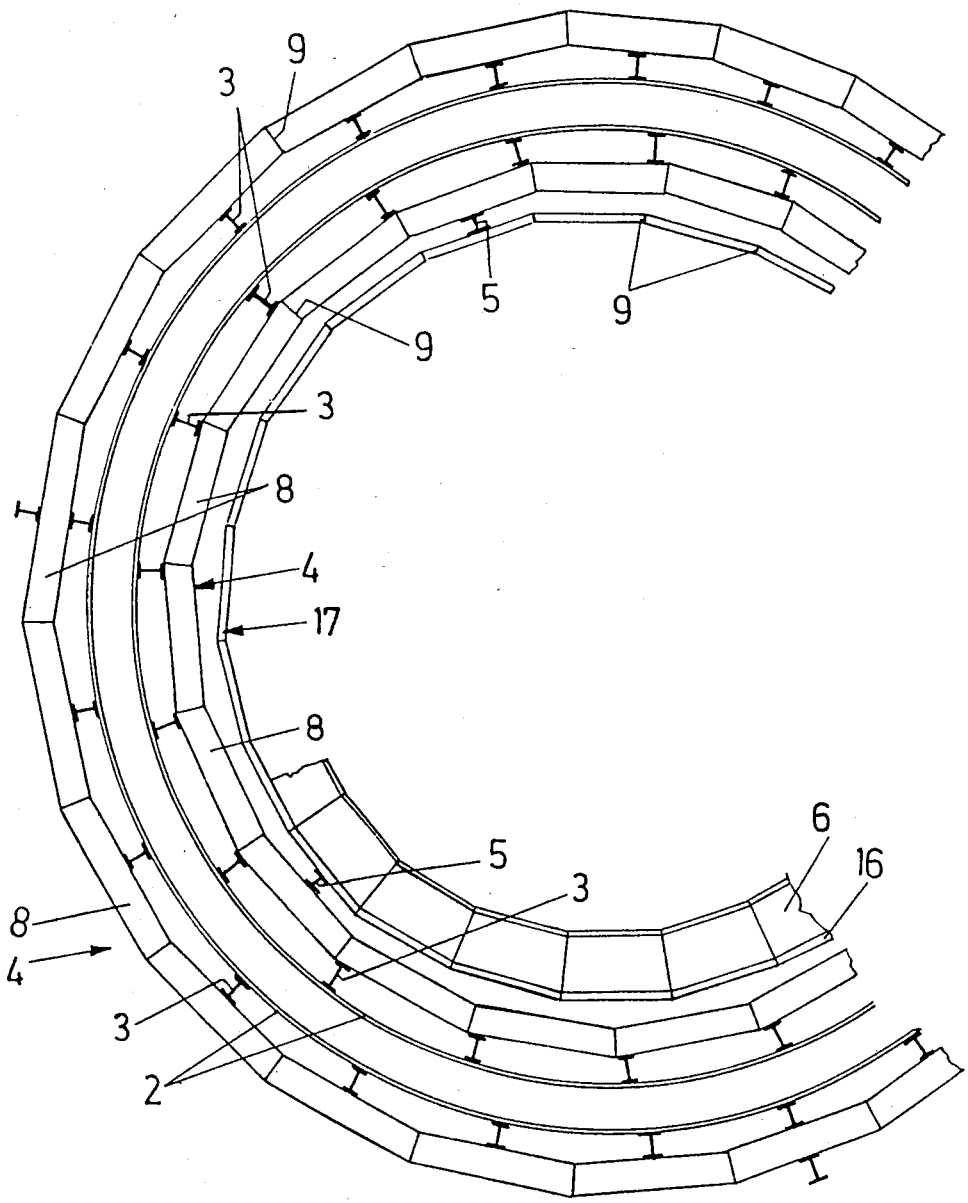
FIG. 2 is a schematic top view thereof.
Figure 3:
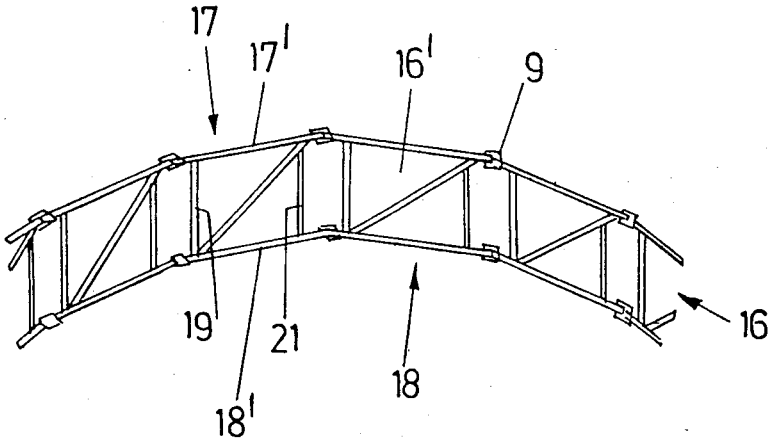
FIG. 3 is a diagramatic perspective view of a portion of the working platform according to the invention.
Figure 4:
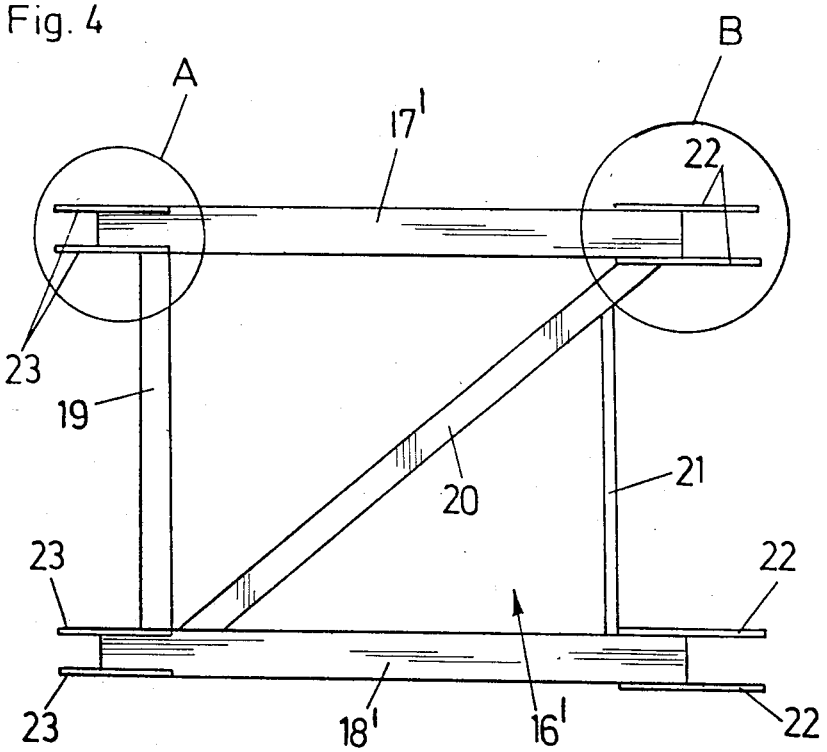
FIG. 4 is a side view of a frame portion.

As can be seen from FIG. 2, each external or internal ring 4 consists of ring portions 8 which are hingedly linked at corners 9.

For reasons of stability, each ring portion 8 is preferably formed by an I-beam. A rectangular tube could equally be used but the use of the I-beam offers advantages with respect to fast fixing when the ring 4 is adapted to a new diameter.

At the corners 9 the link joint can be formed either by an axle or by bending the lower parallel flange of the I-beam.

The internal form has substantially the same construction as the external form. Next to the form skin 2 are the vertical steel beams 3 which are held by polygonal rings 4.

The inner polygonal rings 4, are vertically adjustable.

In the interior of the rings 4 of the internal form there are three pillar-like supports 5 for a working platform 6 carried by a polygonal frame 16, which is a truss comprising an upper chord 17, a lower chord 18 and vertical and inclined bars 19,20.

The frame 16 is formed by separate frame portions 16'. Each frame portion 16' comprises a static load-bearing vertical bar 19 a supplemental bar 21. In the illustrated embodiment upper chord portions or members 17' and lower chord portions or members 18' are formed by rectangular tubes, as are the vertical bars 19 and the inclined bars 20. A different profile, e.g. I-shaped, could also be used if it has the required resistance to buckling.

Figure 9:
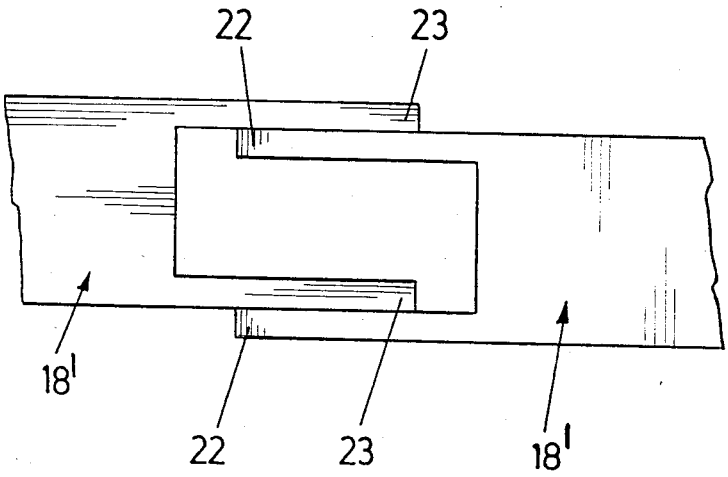
FIG. 9 is a schematic view of the engaging portions of upper and lower chords.

The frame 16 is formed by frame portions 16' which are bolted together. Each upper chord portion 17' and each lower chord portion 18' is at its two ends provided with connecting flanges 22, 23 alternately engaging into each other, as can be seen in FIG. 9, so that each connecting flange 22 contacts a respective connecting flange 23.

The individual frame portions 16' are bolted together at the connecting flanges 22, 23.

Figure 5:
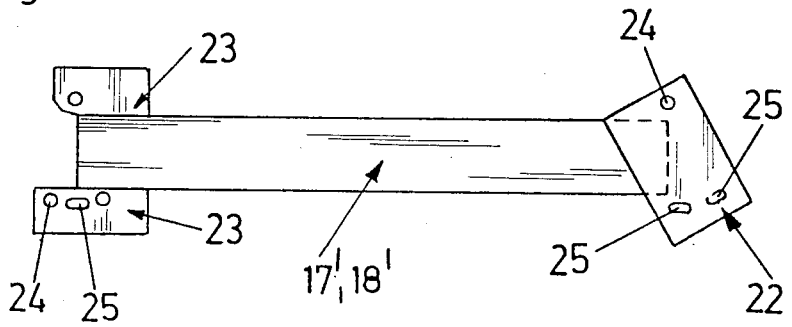
FIG. 5 is a top view of a frame portion.
Figure 6:
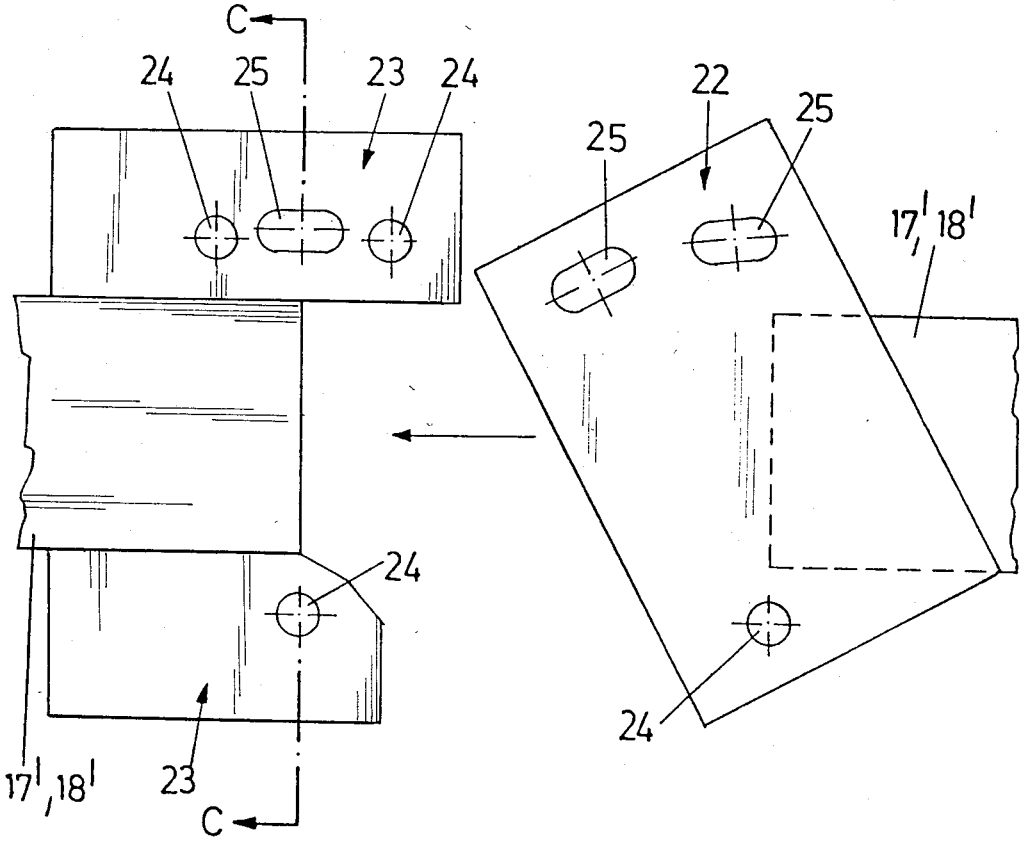
FIG. 6 is an enlarged view of details A, B of FIG. 4, the ends of the frame portions shown adjacent each other.
Figure 7:
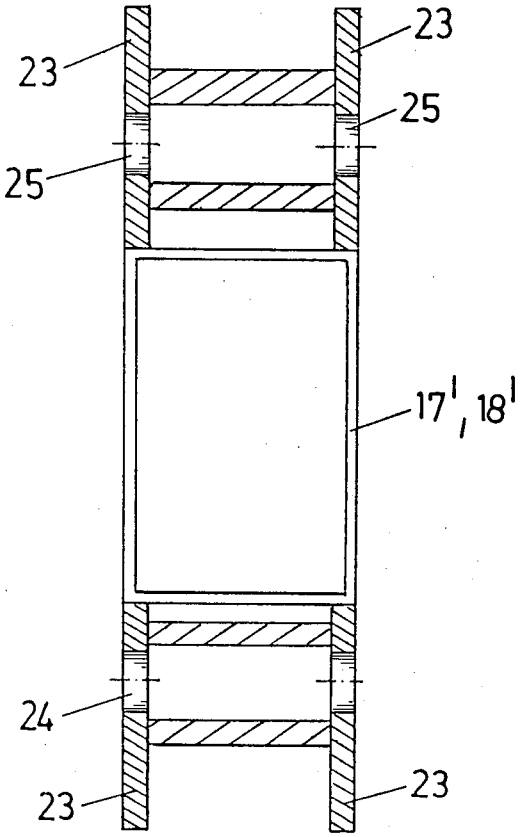
FIG. 7 is a sectional view along line C—C of FIG. 6.

As can be seen in FIG. 5, the connecting flanges 22 are angularly arranged to the longitudinal axis of the upper or lower chord portions 17',18'. Each connecting flange 23 includes two separated parts, one each on each side of the upper and lower chords 17, 18.

Each connecting flange 22, 23 is provided with holes 24, 25 through which connecting bolts extend, a number of the holes being slots 25 lying on a circular arc about a circular fastening hole 24.

It is obvious that by removing the bolts connecting plural frame portions 16', one or more portions can be removed and the angles at the corners of the polygonal ring can be adjusted to form a frame 16 of a smaller diameter.

It is equally possible to open the frame 16 at a joint between two frame portions 16' and to insert new frame portions 16' to increase the diameter of the frame.

Figure 8:
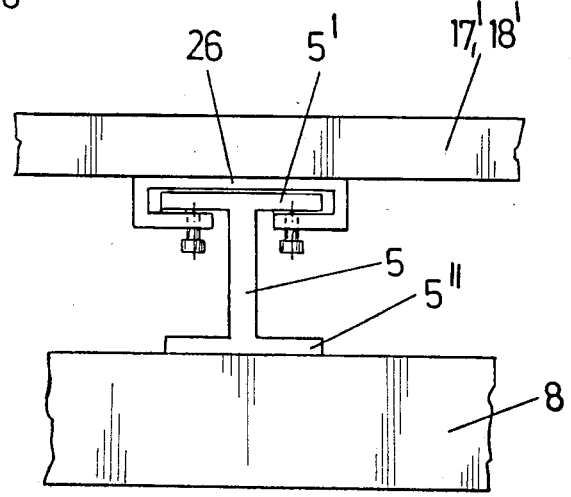
FIG. 8 is a plan view of a connection between frame and support.

As can particularly be seen from FIGS. 2 and 8, the pillar-like supports 5, which are I-shaped members, rest externally against respective frame portions 16' of the frame 16. Each such frame portion 16' has holding means 26 at its upper chord portion 17' embracing a flange 5' of the I-shaped support 5, and the upper chord portion 17' is connected with the flange 5' through this holding means 26, e.g. by being bolted thereto. The second flange 5'' of the I-shaped support 5 is in similar or equal manner connected with the rings 4 of the form scaffold. This connection can also be effected by means of bolts, for example.

Due to the fact that the supports 5 laterally rest against the frame 16 as well as against the rings 4, the form scaffold and the mounting scaffold form a unitary structure. The mounting scaffold is vertically guided in the form scaffold. This arrangement eliminates the need for the working platform to be fastened at its lower side. Moreover, the supports 5 can be secured against buckling directly at the concrete wall, thereby avoiding the need for dangerous operations below the working platform which otherwise would be required.

Figure 10:
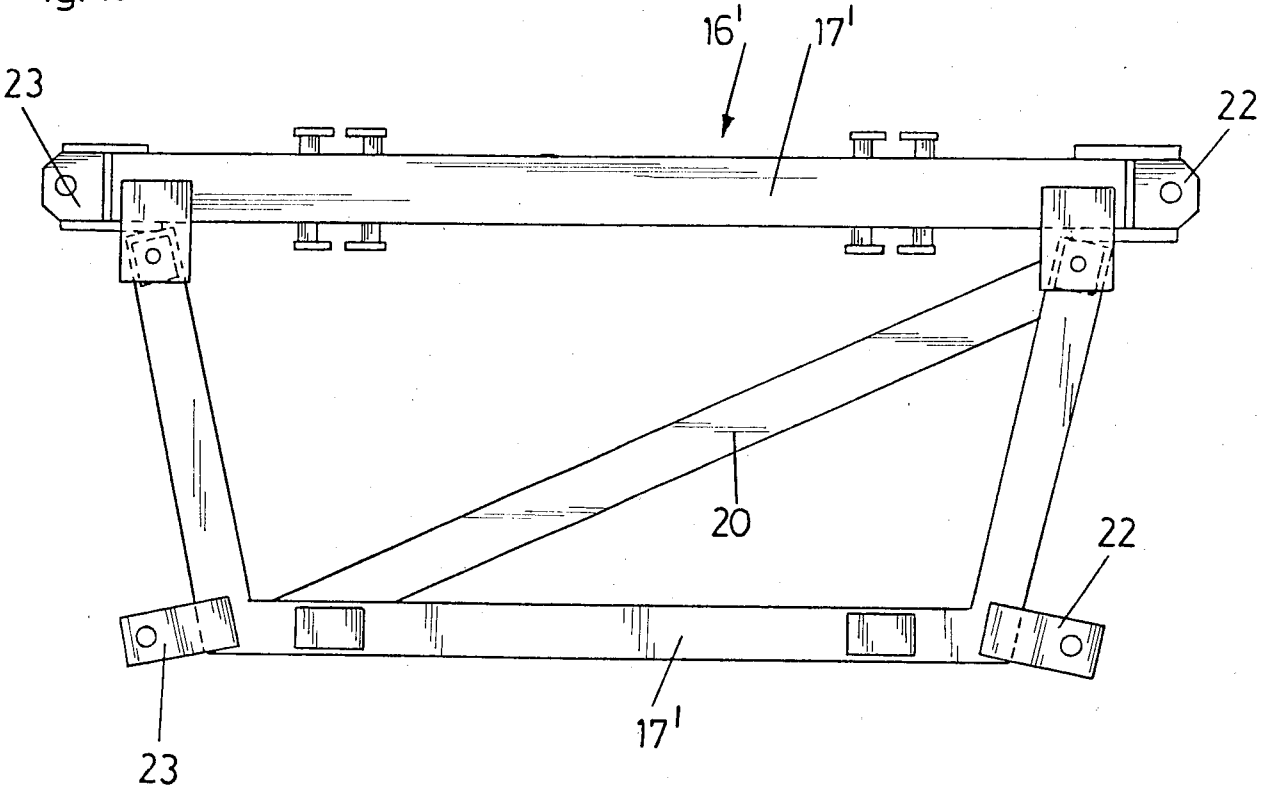
FIG. 10 shows a top view of a further embodiment of a frame portion.
Figure 11:
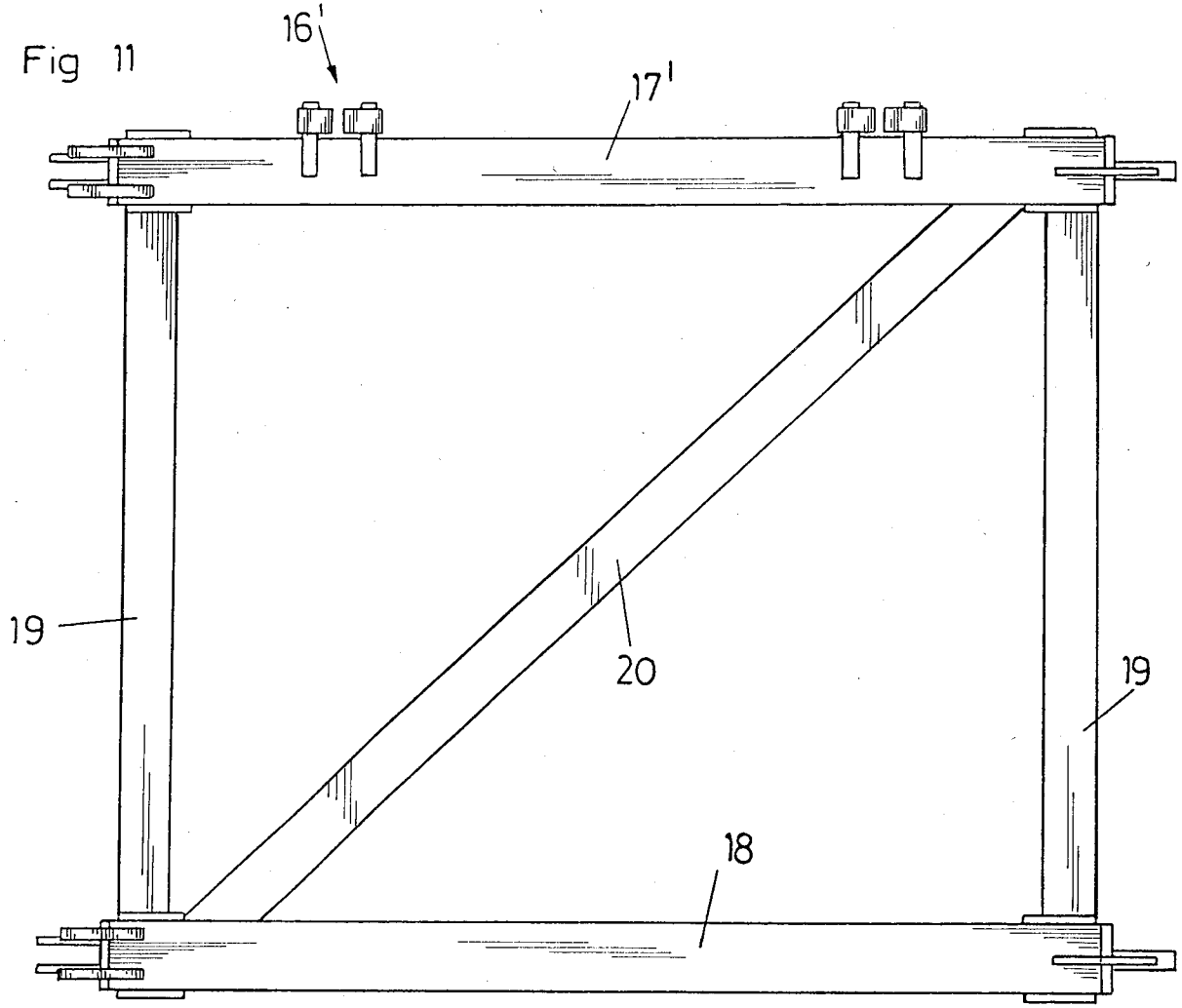
FIG. 11 is a side view of the latter-mentioned frame portion.

To increase the static load-carrying capacity of the frame 16, each frame portion 16' can (as illustrated in FIGS. 10 and 11) be a three-dimensional truss.

The frame portions 16' advantageously are trapezoidal shaped, when viewed from the top.

What is claimed is:

1. A scaffold structure for the construction of a round building from concrete or like material, said structure comprising:

a mounting scaffold including a plurality of vertically spaced, horizontal, substantially annular polygonal rings;

a plurality of vertical supports supported on first sides thereof by said polygonal rings;

a horizontal substantially annular polygonal frame adapted to carry a working platform and to be movable vertically, said frame comprising a plurality of unitary frame portions;

each said frame portion having horizontally spaced opposite ends and comprising parallel horizontal upper and lower members extending longitudinally between said ends and members, including at least one inclined strut, connecting said upper and lower members in fixed vertically spaced relationship;

means for releasably connecting said frame portions end-to-end at varying relative angular relationships and thereby for forming polygonal frames of varying diameter; and holding means on selected said horizontal members of said frame portions for adjustably connecting said frame to second sides of said vertical supports and thereby for adjusting the vertical height of said frame.

2. A structure as claimed in claim 1, wherein each said frame portion has a trapezoidal-shaped configuration as viewed from above.

3. A structure as claimed in claim 1, wherein said connecting means comprise first flanges extending from first ends of said upper and lower members of each said frame portion and second flanges extending from second ends of said upper and lower members of each said frame portions, said frame portions being connected with said first and second flanges alternately overlappingly in contact.

4. A structure as claimed in claim 3, wherein said first flanges are fixed to said upper and lower members to extend at angles to the longitudinal axes thereof.

5. A structure as claimed in claim 4, wherein each said second flange comprises separate flange parts fixed to opposite sides of the respective said second end of said upper or lower member.

6. A structure as claimed in claim 5, wherein said flange parts have formed therein connecting holes.

7. A structure as claimed in claim 6, comprising one said hole in one said flange part and plural said holes in the other said flange part and aligned in a circular arc centered at said one hole.

8. A structure as claimed in claim 7, wherein at least one said plural hole is elongated in the direction of said arc.

9. A structure as claimed in claim 4, wherein said first flange has therein connecting holes.

10. A structure as claimed in claim 9, comprising one said hole in a first end of said first flange and plural said holes in an opposite end of said first flange, said plural holes being aligned in a circular arc centered at said one hole.

11. A structure as claimed in claim 10, wherein at least one said plural hole is elongated in the direction of said arc.

12. A structure as claimed in claim 1, wherein said holding means comprises an equal number of elements fixed to respective said selected frame portions for connection to respective said vertical supports at vertically adjustable positions therealong.

13. A structure as claimed in claim 12, wherein said vertical supports are positioned radially outwardly of said annular frame.

* * * * *